US009068399B2

(12) United States Patent
Lorger

(10) Patent No.: US 9,068,399 B2
(45) Date of Patent: Jun. 30, 2015

(54) DOWN-THE-HOLE HAMMER DRILL

(75) Inventor: Tony Lorger, Eagleby (AU)

(73) Assignee: Drillroc Pneumatic Pty Ltd, Eagleby, Queensland (AU)

( * ) Notice: Subject to any disclaimer, the term of this patent is extended or adjusted under 35 U.S.C. 154(b) by 380 days.

(21) Appl. No.: 13/351,454

(22) Filed: Jan. 17, 2012

(65) Prior Publication Data

US 2012/0118648 A1 May 17, 2012

Related U.S. Application Data

(63) Continuation-in-part of application No. 12/445,850, filed as application No. PCT/AU2007/001580 on Oct. 17, 2007, now Pat. No. 8,109,348.

(30) Foreign Application Priority Data

Oct. 20, 2006 (AU) ..... 2006905840

(51) Int. Cl.
*E21B 4/06* (2006.01)
*E21B 4/14* (2006.01)

(52) U.S. Cl.
CPC ..... *E21B 4/14* (2013.01)

(58) Field of Classification Search
CPC ..... E21B 4/06; E21B 4/14
USPC ..... 175/293, 296, 297
See application file for complete search history.

(56) References Cited

U.S. PATENT DOCUMENTS 1,220,483 A 3/1917 Williams et al.
2,287,157 A * 6/1942 Wolff ..... 175/106
2,665,115 A 1/1954 Bassinger
2,859,733 A 11/1958 Bassinger et al.
2,873,093 A 2/1959 Hildebrandt et al.
3,416,613 A 12/1968 Henderson (Continued)

FOREIGN PATENT DOCUMENTS

EP 244986 11/1987
EP 548008 6/1993

(Continued)

OTHER PUBLICATIONS

Formed.2011, In Merriam-Webster Online Dictionary, Retrieved Mar. 8, 2011, from http://www.merriam-webster.com/dictionary/formed.

(Continued)

*Primary Examiner* — Brad Harcourt
(74) *Attorney, Agent, or Firm* — Davis & Bujold, P.L.L.C.; Michael J. Bujold

(57) ABSTRACT

A down-hole hammer includes a two-piece drill bit retained in a casing having an interior surface with a plurality of longitudinal grooves formed therein. The bit shank and the casing are rotationally connected by a number of pins received in the grooves. A symmetrical free piston divides the casing into an upper working chamber and a lower working chamber. The piston slides on an air control assembly including a ported tube extending axially from said air supply to an axial bore in the shank of the bit to guide exhaust air through discharge ports at the cutting face of the bit, the bit reciprocating on the end of the tube. The upper and lower check valves in the air control assembly and openable by supply pressure against a spring bias in response to working fluid supply pressure.

5 Claims, 8 Drawing Sheets

(56) References Cited

U.S. PATENT DOCUMENTS

| | | | | |
|---|---|---|---|---|
| 3,804,181 | A | 4/1974 | Curington et al. | |
| 3,896,886 | A | 7/1975 | Roscoe, Jr. | |
| 3,924,690 | A | 12/1975 | Shaw | |
| 4,015,670 | A * | 4/1977 | Rear | 173/15 |
| 4,254,639 | A | 3/1981 | Teramachi | |
| 4,278,135 | A | 7/1981 | Curington | |
| 4,702,326 | A * | 10/1987 | Salmi et al. | 173/104 |
| 4,932,483 | A | 6/1990 | Rear | |
| 5,511,628 | A | 4/1996 | Holte | |
| 5,564,510 | A | 10/1996 | Walter | |
| 5,715,897 | A | 2/1998 | Gustafsson | |
| 5,722,495 | A | 3/1998 | Rear | |
| RE36,848 | E | 9/2000 | Bui et al. | |
| 6,131,672 | A | 10/2000 | Beccu et al. | |
| 6,164,393 | A | 12/2000 | Bakke | |
| 6,454,026 | B1 | 9/2002 | Shofner | |
| 6,543,557 | B2 | 4/2003 | Glen | |
| 6,789,632 | B2 | 9/2004 | Green | |
| 7,712,554 | B2 | 5/2010 | Glen | |
| 2002/0066599 | A1 | 6/2002 | Glen | |
| 2004/0206550 | A1 | 10/2004 | Glen | |
| 2005/0126822 | A1 | 6/2005 | Campbell et al. | |
| 2005/0173158 | A1 | 8/2005 | Jacobsson et al. | |
| 2006/0000646 | A1 | 1/2006 | Purcell | |
| 2007/0102196 | A1 | 5/2007 | Bassinger | |

FOREIGN PATENT DOCUMENTS

| | | |
|---|---|---|
| EP | 1757769 | 2/2007 |
| IE | 82751 | 2/2003 |
| JP | 06212872 | 8/1994 |
| WO | 2006015454 | 2/2006 |
| WO | 2006/032093 | 3/2006 |
| WO | 2007077547 | 7/2007 |
| WO | 2008044458 | 4/2008 |
| WO | 2009124051 | 10/2008 |

OTHER PUBLICATIONS

Integrally. 2011. In Merriam-Webster Online Dictionary, Retrieved Mar. 8, 2011, from http://www.merriam-webster.com/dictionary/integrally.

* cited by examiner

FIGURE 3B
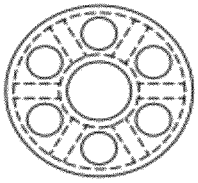
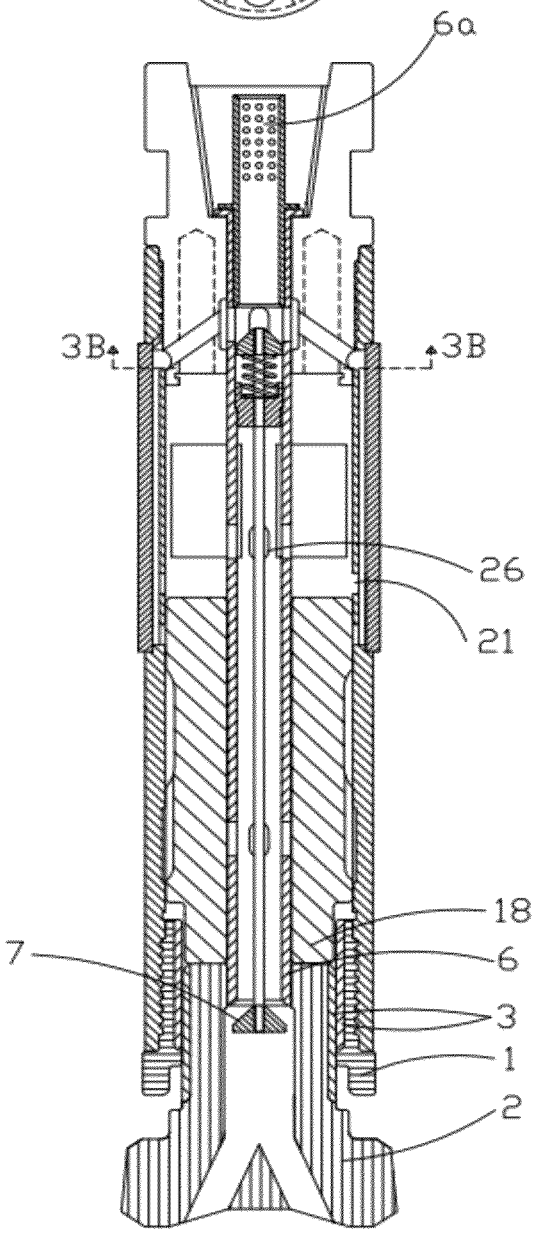
FIGURE 3A

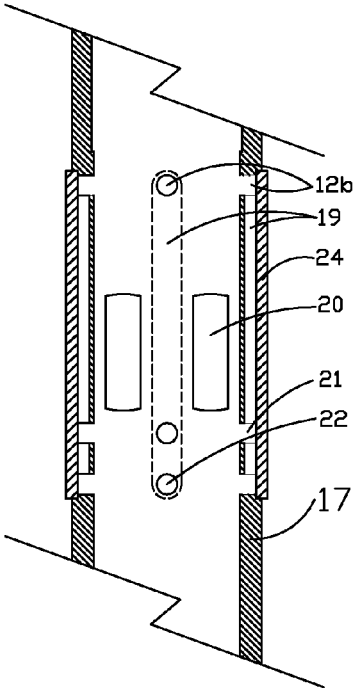
FIGURE 4A
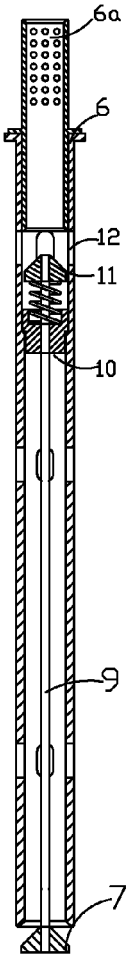
FIGURE 4B
FIGURE 4C
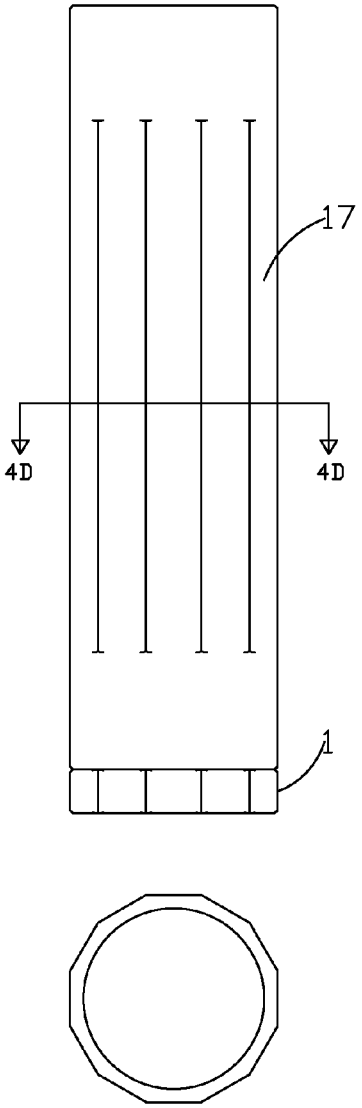
FIGURE 4D

DOWN-THE-HOLE HAMMER DRILL

This application is a continuation-in-part of copending application Ser. No. 12/445,850, filed Apr. 16, 2009, which was the U.S. national stage of international application PCT/AU2007/001580, filed Oct. 17, 2007.

FIELD OF THE INVENTION

This invention relates generally to down-hole hammer drills and more particularly to a down-hole compressed fluid driven hammer drill as described below.

BACKGROUND OF THE INVENTION

Down-hole hammers generally comprise a drill bit as the lowermost component in the hammer assembly. The drill bit has a major diameter portion referred to as the bit head, and determines the diameter of the hole drilled. The bit head is traditionally integral with an upper, splined bit shank, which is slidably engaged and retained within a driver chuck. The driver chuck has an internal spline for engagement with the drill bit shank spline, and an outer threaded portion to engage a down-hole hammer barrel.

The bit shank splined section, when engaged within the driver chuck, is mechanically engaged rotationally, but is free to slide axially. To limit the extent of axial travel, and to prevent the drill bit from sliding out of engagement altogether, the drill bit shank has a section of reduced diameter above the spline, for a distance equivalent to the desired travel length of the spline plus the thickness of a retaining mechanism. This retaining mechanism is a bit retainer ring, made of two semi-circular sections with inner and outer diameters that are placed from each side around the reduced diameter of the bit shank thereby forming a near complete ring. The final section above the reduced diameter is the bearing land, which varies in form but is always of substantially larger diameter than the reduced diameter, so as to limit the axial travel as the bearing land comes to rest on the bit retainer ring.

In use, the driver chuck is lowered onto the drill bit shank, with the mating splines engaged. The two halves of the bit retainer ring are fit to the reduced diameter portion of the bit shank and rest atop the driver chuck. The drill bit, chuck and retainer ring sub assembly are threaded into the down-hole hammer casing/barrel. The bit retainer ring, now encased circumferentially within the down-hole hammer barrel, driver chuck below, and drill bit guide bush above, permits limited axial travel of the splined engagement.

It would be desirable to reduce the manufacturing cost of drill bits. The most effective way of doing so is to redesign the product so as to reduce its mass and length, while maintaining a robust and practical product.

EP1757769A1 discloses splines machined into the casing, a chuck fitted from above and a drill bit screwed into the chuck from below, providing for a shorter and more cost effective drill bit.

WO2008044458A2 discloses a type of drill bit for down-hole hammer use that is designed to be short and efficient to manufacture and use.

WO2009124051A2 discloses two embodiments of drill bits for down-hole hammer use that are designed to be short and efficient to manufacture and use.

WO2007077547A1 discloses a drill bit with a shorter shank than conventional types, also having threaded attachment.

My prior application, identified in the first paragraph above, disclosed embodiments of the invention illustrated in FIGS. 1-6 of the drawings. The description and claims below describe new embodiments, illustrated in FIGS. 7-9.

SUMMARY OF THE INVENTION

In its broadest sense, the present invention includes: a hammer casing; a free piston motor in the casing; a drill bit having a separable bit shank extending from a bit head to an anvil end, the bit shank being keyed for reciprocating and driven rotation in the bore of a casing or chuck; and a number of keys or pins rotationally connecting the bit shank to the casing or chuck.

The check valve tube may comprise a perforate cylinder or the like functioning as a debris screen. Alternatively, the upper poppet check valve may be independent of the lower check valve in that the check valve tube and poppet valve may be associated with a spring and form a poppet valve assembly locatable at the upper end of the porting tube, seating onto said check valve tube and located directly adjacent the pressure supply ports of said porting tube, spring actuated from above by a connecting rod or from below by a spring supported by choke plug.

The pins may be considered sacrificial drive engagement pins, or keys, and may be of any suitable cross sectional shape as is practical and of any number as is practical. For example, the pins may be round section drive pins or may be of a section more like a keyway key.

In my prior application, I described the use of alternating long and short pins, whereas in the new embodiment of FIGS. 7-9, the pins are all the same length and function, the drill bit's head and shank are now two separate parts; this enables the shank/anvil to fit into the casing in the new manner described below, and allows the pins to be of uniform length and function. This improvement eliminates the need for a driver, as does the embodiment of FIG. 6, and provides a mechanically detachable drill head.

BRIEF DESCRIPTION OF THE DRAWINGS

The invention will be further described with reference to a embodiments of the invention as illustrated in the accompanying drawings and wherein:

FIG. 3A is the hammer assembly of FIG. 1 lifted away from contact with the rock;

FIG. 3B is a view of the top adapter sub through section 3B of FIG. 3A.

FIG. 4A is a sectional elevation of the barrel porting construction of the down-hole hammer assembly of FIG. 1;

FIG. 4B is a view of the hollow porting tube of the apparatus of FIG. 1;

FIG. 4C is an elevation of the barrel and driver chuck exterior of the apparatus of FIG. 1;

FIG. 4D is a sectional view indicating the polygonal outer surface of the barrel and driver chuck exterior of the apparatus of FIG. 1;

DESCRIPTION OF THE PREFERRED EMBODIMENTS

Figure 1:
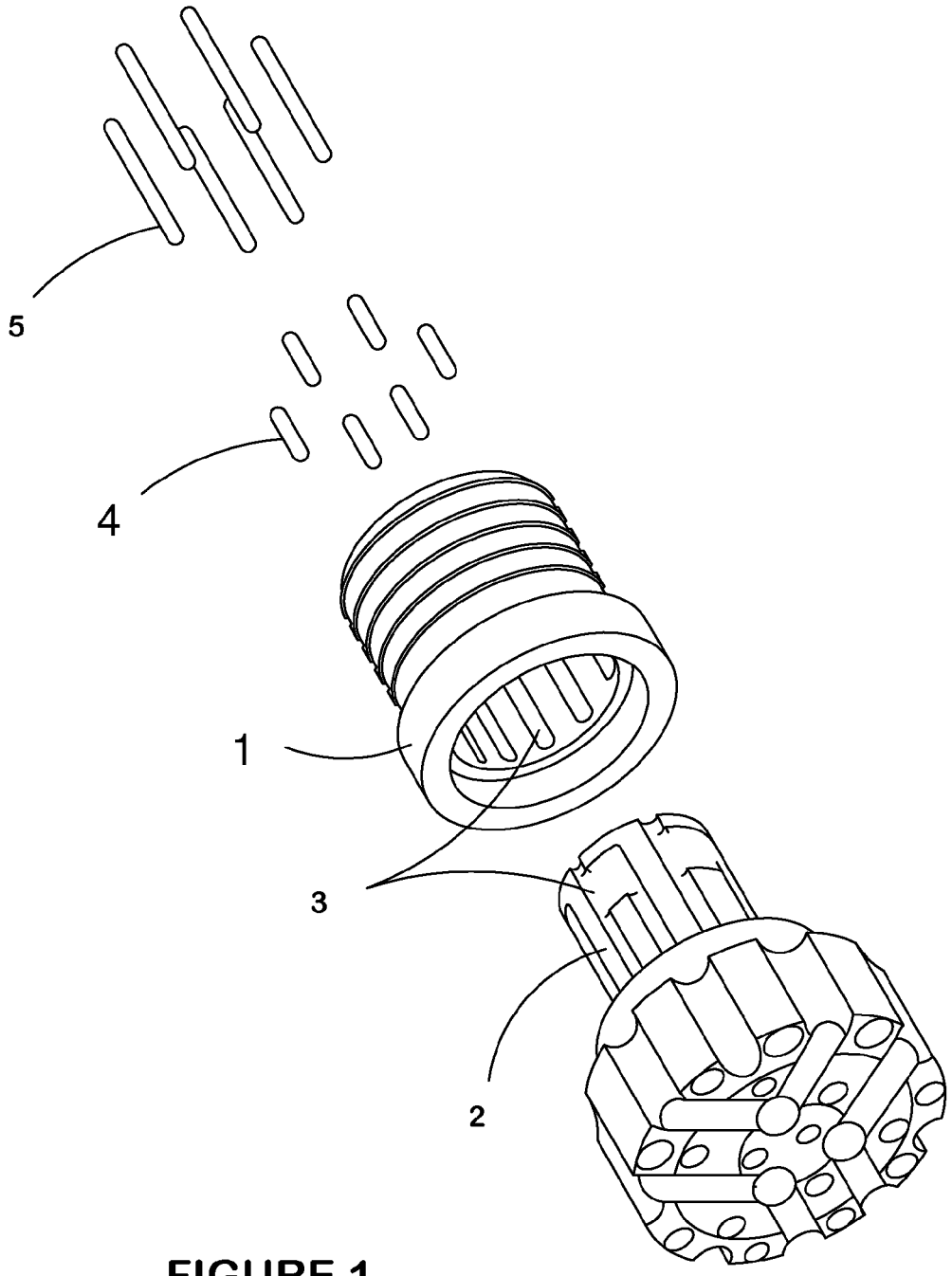
FIG. 1 shows an isometric exploded view of apparatus in accordance with the present invention.

In the hammer of FIGS. 1 to 5, a driver chuck 1 fits over a drill bit shank 2 and has a running fit, free to rotate. Longitudinal grooves 3 are machined on the inside of the driver chuck and on the outside of the drill bit shank The driver chuck is rotated on the drill bit shank until the grooves align. Shorter pins 4 are inserted into the visible holes formed by the alignment of the drill bit grooves and driver chuck grooves 3, the chuck is indexed until the next alignment of the grooves, and the longer pins 5 are then inserted.

At this point the driver chuck and drill bit are engaged rotationally, and with the shorter pins 4 now no longer visible but engaged internally, extending axially and spaced circumferentially, the bit may freely slide a desired distance due to the internal engagement of the shorter pins. The shorter pins, which determine the allowable sliding movement, may be formed integral with either the drill bit or driver chuck. The longer pins, or keys, provide the majority of rotational drive engagement.

Figure 5:
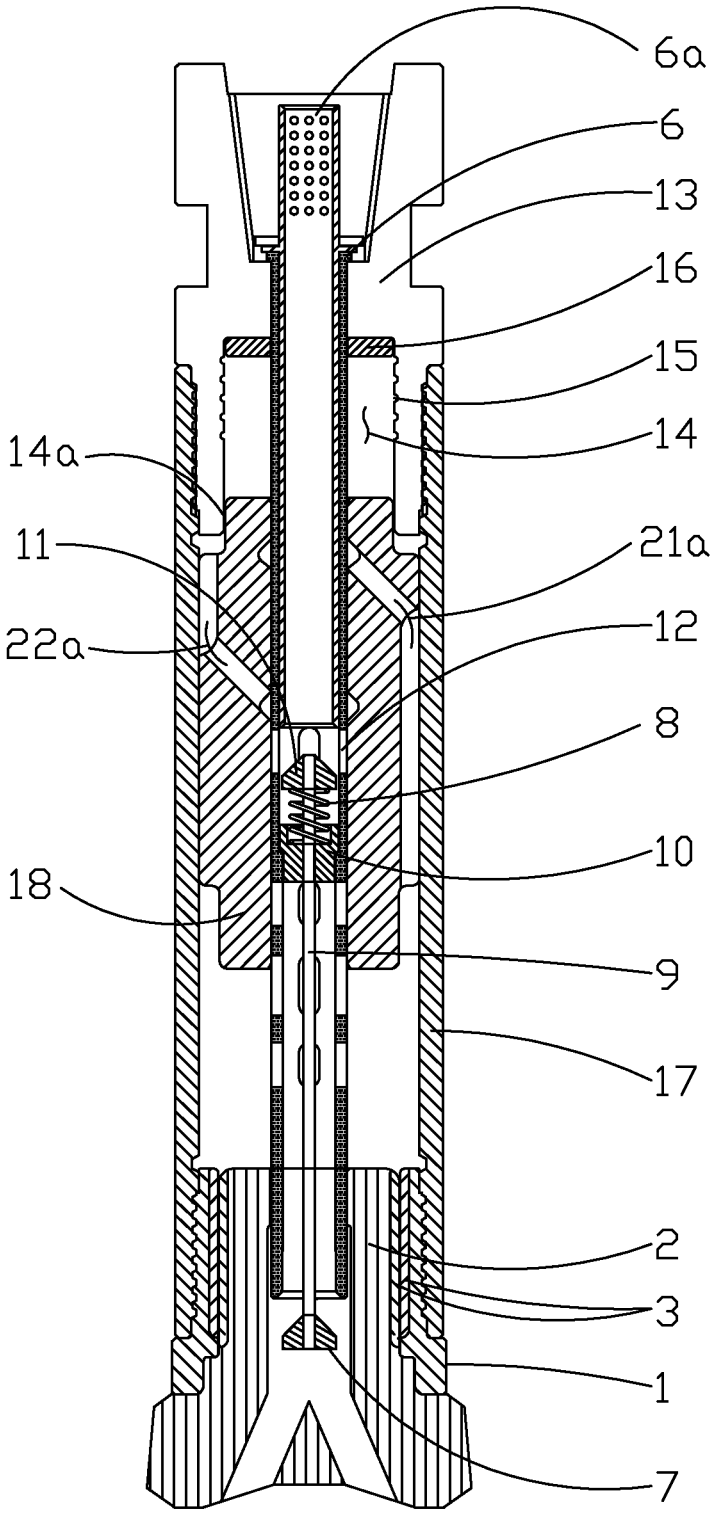
FIG. 5 is a sectional elevation of an alternative embodiment of the present invention.
Figure 6:
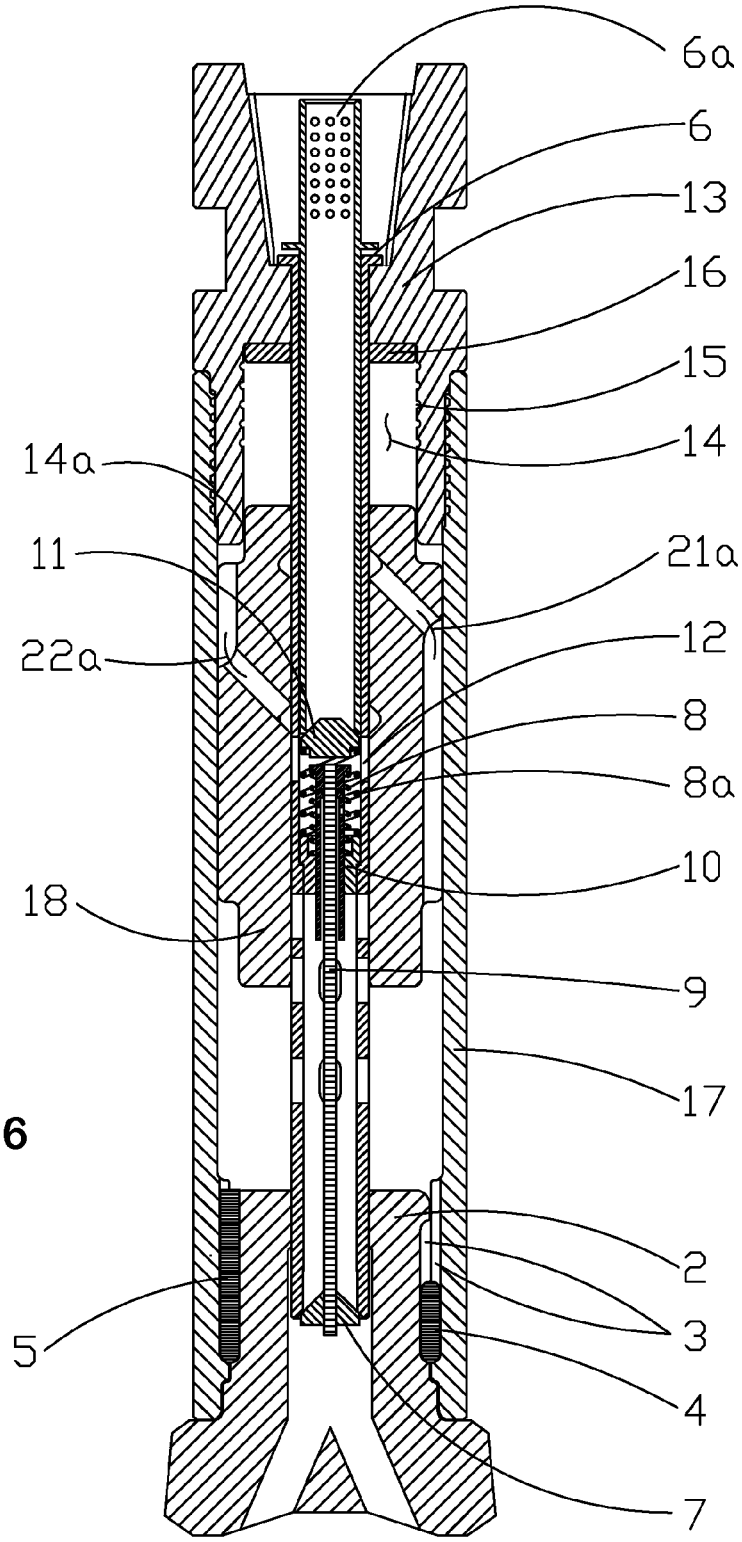
FIG. 6 is a sectional view of another embodiment in which the upper poppet is independent of the lower check valve.

The embodiment of FIG. 6 is functionally identical to that of FIG. 5, but for the elimination of the driver chuck, whose function has been integrated into the casing by means of simply duplicating the grooves 3 into the lower casing. The replaceable pins/keys as a drive and linear retention mechanism makes this synergy possible.

Figure 2A:
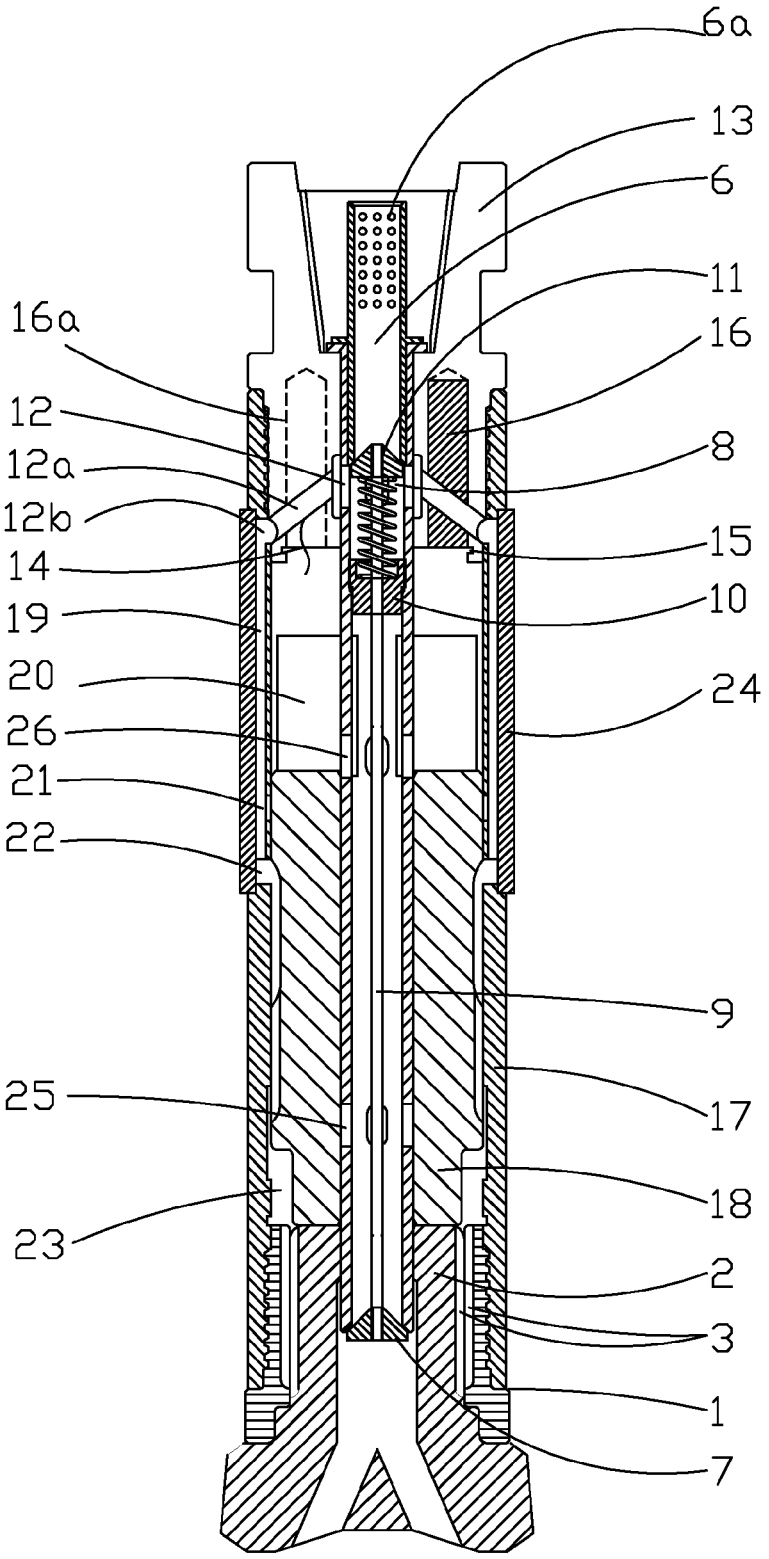
FIG. 2A shows an axial section of the down-hole hammer assembly of FIG. 1.

In operation, as shown in FIG. 2A, compressed air enters hollow port tube 6 through a central bore of top adapter sub 13, and forces open pressure port check valve 11 against a spring 8 supported by choke plug 10, simultaneously opening exhaust check valve 7 via connecting rod 9. The compressed air passes through pressure port 12, through conduit 12*a*, aligning with feed port 12*b* to pressurize porting channel 19, to feed delivery ports 21 and 22. Lower chamber 23 is energized by delivery port 22 to raise the piston 18. As the piston rises, lower chamber 23 dumps to atmosphere via exhaust port 25, delivery ports 21 and 22 begin to energize the piston compression chamber 14 via transfer ports 20, the piston is forced down to impact the drill bit anvil, dumping the piston compression chamber to atmosphere when exhaust port 26 is exposed, and the cycle repeats continually while sufficient compressed fluid is supplied, or until the cycle is interrupted.

In FIG. 3A, the hammer has been lifted away from contact with rock, so the drill bit 2 is free to fall the distance permitted by the internally engaged shorter pins 4 shown in FIG. 1, located within axial grooves 3, followed by the reduced diameter striking end of piston 18 entering the upper portion of driver chuck 1 vacated by the drill bit 2, thereby interrupting the percussive cycle as delivery port 21 becomes open to exhaust port 26 and dumps to atmosphere through exhaust check valve 7 until the cycle is reactivated. Note the hollow porting tube 6 remains in cooperation with the drill bit bore at all times.

The lower check valve arrangement is made possible by the hollow porting tube 6 extending from its upper support in the central bore of top adapter sub 13 into the central bore of drill bit 2, and may be utilized as either an upper pressure check valve 11 or lower check valve 7, or both in unison via connecting rod 9. The co-operation of the porting tube within the drill fortifies alignment of the porting tube and permits an advantageous location of an exhaust check valve. The lower exhaust check valve positively and instantly prevents debris contamination at the first possible point of entry. This design is therefore considerably more resistant to entry of potentially damaging debris than prior down-hole hammers.

Additionally, the porting tube 6 controls the piston return chamber 23 volume, thereby eliminating requirement of a component known as a foot valve or exhaust tube, as described in prior art such as that described above.

In the present invention, cooperation of the hollow porting tube and drill bit is made practicable due to the driver chuck and drill bit combination design, in that the drill bit shank 2 is well supported in alignment within the driver chuck 1, and has a substantial wall thickness and a bore able to accommodate a porting tube of sufficient cross-sectional area for the required airflow, the drill bit bore fashioned to provide sufficient cross-sectional area for passage of exhaust fluid through the check valve 7.

A piston compression chamber 14 is formed integrally within the top adapter sub 13. FIG. 2 shows a means for quickly and simply altering the piston compression chamber 14 volume. Within piston compression chamber 14 as part of the top adapter sub 13 are formed a series of axial holes 16*a*. Any practical number of inserts 16 are inserted into the holes, thereby incrementally altering the volume capacity of said chamber, subsequently altering compressed fluid consumption and maximizing efficiency of the drill for any suitable compressor delivery output. The inserts are retained in the holes by known means, such as a circlip into groove 15

FIG. 4A shows the barrel porting. Ports 12*b*, 21, and 22 are radially through-drilled into the barrel 17. Channel 19 is milled longitudinally at a depth and length suitable to encompass the drilled ports. Cap 24 is fixed in known manner to cover and seal the ports from the outside. Thus, ports 12*b*, 21 and 22 are interconnected by a passage 19 formed between inner and outer surfaces of barrel 17.

Internal transfer ports 20 are fly-cut into the barrel bore in a known manner. The effect on torsional rigidity is minimal and acceptable because only about six percent of the barrel circumference is affected per channel since the porting channel 19 need have only a cross sectional area equal to any one of the supply or delivery ports, and much of the removed metal is restored as a cover cap 24. Furthermore, it is not necessary to fashion a cover cap flush fitting with the barrel outside diameter; however, it would be entirely acceptable to do so if the cover cap were to protrude the barrel outside diameter up to but not exceeding the diameter of the drill bit.

With this design, I have found there to be ample material thickness to accommodate a fluid conduit 19 in the manner described. This is advantageous in that material input is kept at a minimum since manufacturing of an inner cylinder is negated, as are the problematic methods of retaining the inner cylinder.

The present invention described thus far is of non-ported piston type design. While the general flow characteristics of this type of porting are known and not part of this patent application, it has a bearing on how some of the components are designed. Another embodiment of the invention, shown in FIG. 5, maintains all of the essential features of the first embodiment, with some features altered according the porting arrangement of a ported piston. A further embodiment, illustrated in FIG. 6, has the feature of independently actuated check valves and the elimination of a chuck by incorporating the function of the chuck into the casing. Yet another embodiment of the invention, shown in FIGS. 7-9, maintains all of the essential features of the previous embodiment, with some feature altered according to the arrangement of a symmetrical piston incorporating a bush for guidance, timing and sealing, and a two-piece drill bit.

Figure 7:
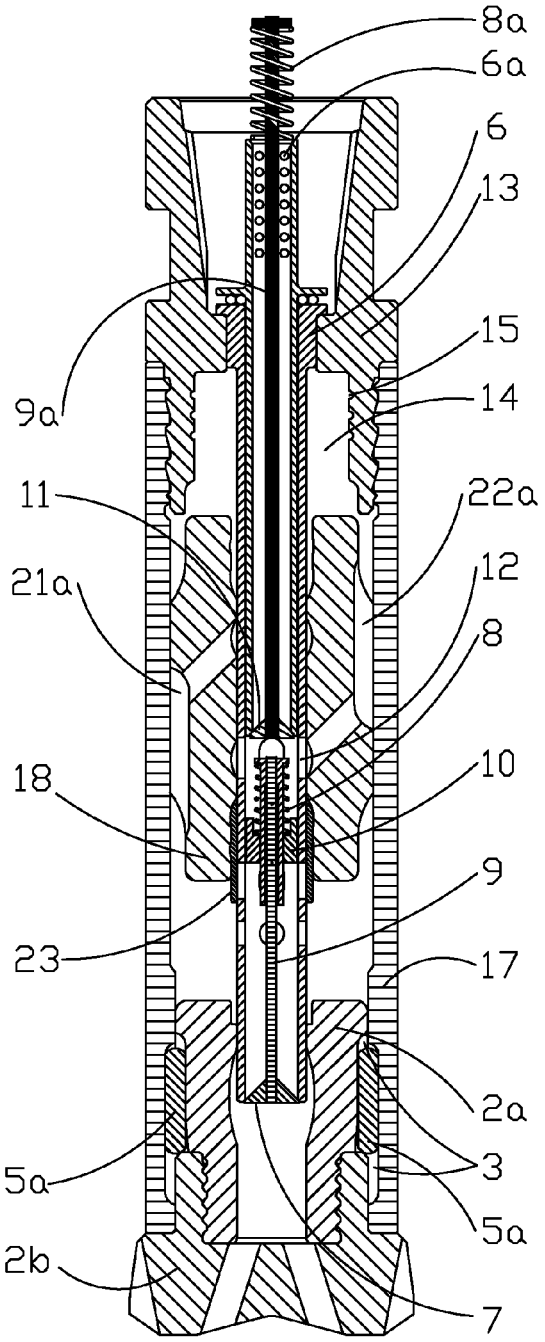
FIGS. 7 and 8 are sectional views of another alternative embodiment of the invention.
Figure 8:
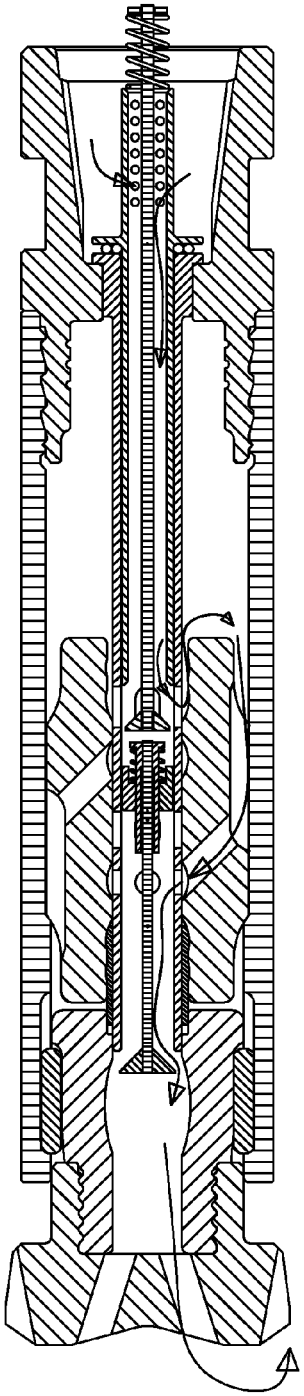
Figure 9:
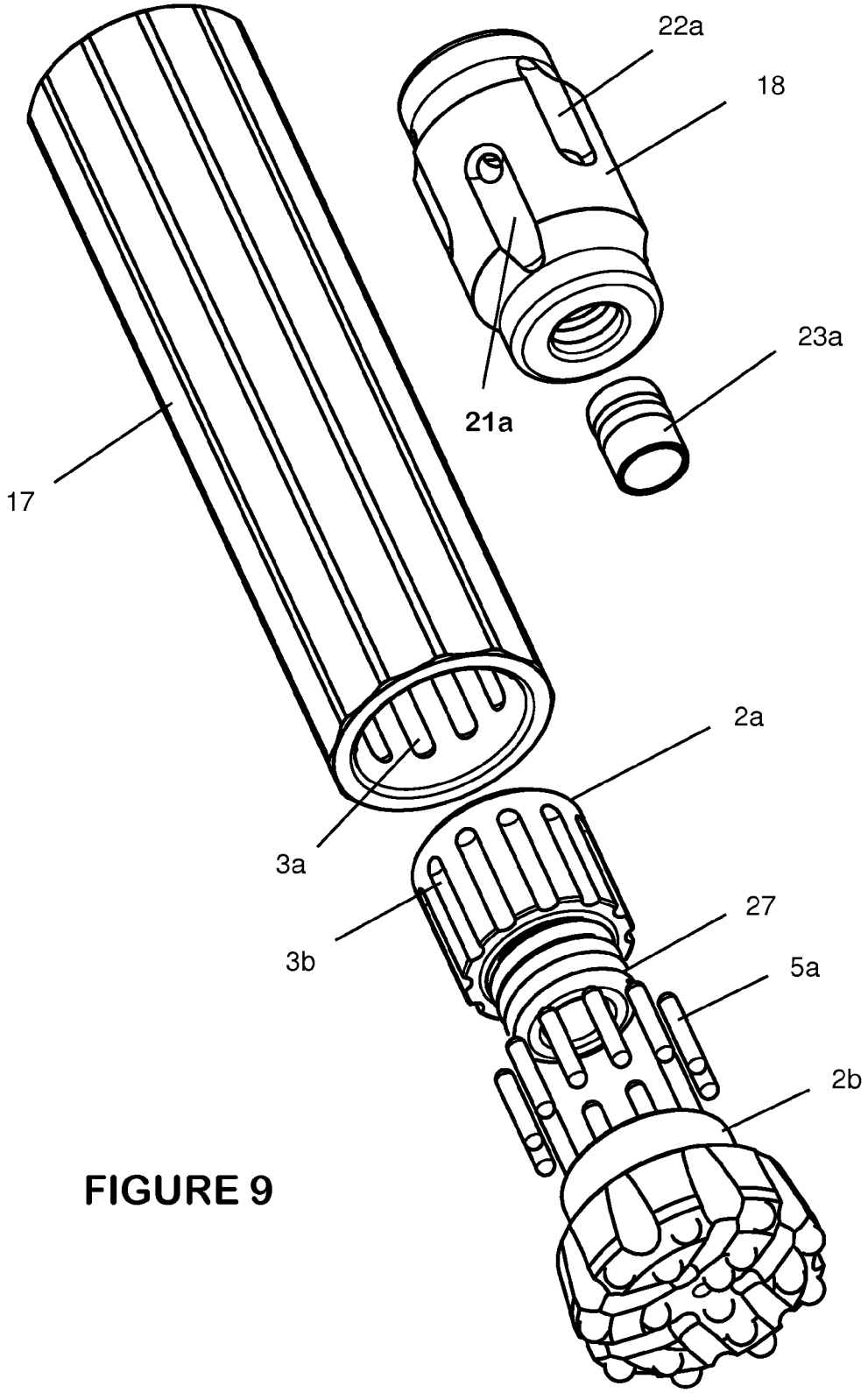
FIG. 9 is an exploded perspective view thereof.

The embodiment of FIGS. 7-9 is substantially similar in construction and operation to the embodiments of FIGS. 1-6, and like reference numbers denote like components.

Compressed air enters porting tube 6 and directly engages the hammer via pressure supply port 12 to begin operation. In turn, the check valve 7 is forced open by exhaust fluid against its spring 8 via connecting rod 9. The spring is supported by choke plug 10. The check valve arrangement may also be a sliding piston 11 atop the spring which is forced down against the spring by incoming compressed fluid, thus exposing the pressure supply port 12. The check valve arrangement is thus mounted internally within the hollow porting tube, and may be either or both of the aforementioned arrangements in unison. See FIG. 4B.

With reference particularly to FIGS. 5-7, a series of retainer circlip grooves 15 are formed within the piston compression chamber 14 as part of the top adapter sub 13. An insert or inserts is placed in the piston compression chamber. The inserts are retained by a circlip (not shown) in an appropriate one of the grooves 15, thereby altering the volume capacity of said chamber, subsequently altering compressed fluid consumption and maximizing efficiency of the present invention for any suitable compressor delivery output.

The piston 18 is ported from its upper and lower extremities via porting conduits 21*a* and 22*a*, such porting conduits cooperating with porting apertures in hollow porting tube 6 to effect reciprocal motion, and may be fashioned to slidably co-operate at the top of its stroke with the bore of said piston compression chamber at 14*a* in FIG. 5. A long standing problem associated with the use of known down-hole hammers is the difficulty of disassembly, due to the great torsional forces and vibration which cause the threads to become very tight and therefore difficult to undo. Hence there is a need for specialty equipment to grip and apply high force to disassemble the down-hole hammer for servicing, and often there is the persistent problem of the gripping tool or mechanism to slip, or fail to grip, on the hard outer cylindrical surface of a known down-hole hammer assembly.

In the present invention, for reasons of safety and ease of handling, are provided longitudinal flats on the outer surfaces of the barrel and driver chuck (see FIGS. 4C and 4D), typically twelve in number. Such a peripheral shape creates no notable restriction to the passing by of exhaust air laden with crushed rock when drilling, but provides additional assurance of positive non-slip attachment of appropriate servicing tools, such as in Publication No. WO 2006015454.

The further embodiment of FIGS. 7-9 involves the integral rotation and retention means as displayed in FIG. 6: the drive chuck is rendered obsolete by the longitudinal drive pin grooves/keyways being machined directly into the lower portion of the casing.

The further embodiment differs from that of FIG. 6 in that the drill bit head 2*b* is made as a detachable component. The shank portion 2*a* of the drill bit has an external helical thread 27. While prior drills have had screw-on heads, the way in which the shank/anvil 2*a* is located and supported and driven within the casing is new, and is explained in detail below.

The pin drive and linear retention mechanism design permits the loading of the shank/anvil 2*a* from either end of the casing but preferably from the lower end, as would be generally convenient in field use. In that case, the drive/stroke limiting pins 5*a* are inserted into the corresponding grooves within the casing, the shank/anvil 2*a* then pulled downward to engage the pins, and thus the shank/anvil is engaged rotationally with the casing via the pins but may not be pulled out of the casing longitudinally due to the engagement of the pin ends in the lower end of the casing grooves and the upper end of the shank/anvil grooves.

The drive/stroke limiting pins 5*a* of the embodiment of FIGS. 7-9 are sacrificial and replaceable, and are all the same length, thus simplifying assembly.

With the shank/anvil in place with the pins, the drill head may then be threadably attached to said shank/anvil, thus the assembly becomes complete.

The reader and those skilled in the art should be aware that in almost all cases, a worn drill bit of the down-hole hammer type is discarded because the drill bit head is worn to below serviceable diameter, while the shank/anvil portion is generally in good serviceable condition but must be discarded regardless, thus the advantages of the present chuckless, casing mounted, shank/anvil embodiment are evident:

1) A drill shank/anvil will outlast a drill bit head by approximately 5:1; therefore, material usage and waste disposal are reduced when only the drill head portion must be replaced.
2) There is no requirement to manufacture, maintain, or replace a driver chuck at all, it is obsolete, yet more synergy and economic efficiency. To replace a worn drill head becomes a simple matter of unscrewing the old and screwing on the new (or reclaimed) drill head, while the shank/anvil remains engaged within the casing, effectively "re-using" the shank/anvil that would otherwise have been discarded if the drill bit were a singular unitary item comprising drill head and drill shank/anvil. From the manufacturing perspective, one can make a drill head with about 50 percent of the drill bit material required for the embodiments of FIGS. 2, 5 and 6.
3) The shank/anvil may be threadably attached to the drill bit head, and as such the threads may be formed as parallel or tapered, male or female in either direction. Other means of mechanical engagement are possible and would be apparent to one skilled in the art.

Another feature of the embodiment of FIGS. 7-9 is that of a symmetrical piston 18, so that if the striking surface is damaged, the piston is can be reversed end for end, thus effectively extending the service life instead of replacing a major component. This feature is made possible within this design by means of an inserted sealing/guidance/port timing bush 23 fitted to only the lower end bore of the piston. If the piston 18 is to be reversed then the bush must remain at the lower end, and the upper end remains open. Both ends of the piston bore are oversize relative to the port tube 6 on which the piston slides, the strike end being bushed for sealing and timing of the return stroke working chamber and the upper end permitting fluid flow in the drop-open condition (hammer cycle interrupted inducing full-flow bypass for flushing, indicated by arrows in FIG. 8).

A symmetrical, or double ended piston costs no more to produce and may provide up to double the usual service life.

A further feature of the embodiment of FIGS. 7-9 is that while the check valve(s) function in the same manner as the other embodiments, it can be seen that the upper check valve is able to be sprung (operated) from above via a connecting rod 9*a* as well as from below (FIG. 6). Therefore, the combination of check valve arrangements maintains the actual position of the poppet valves and seats as described throughout the disclosure but may be sprung in alternate ways.

FIGS. 7 and 8 show the embodiment in two phases, FIG. 7 being in the bit closed condition which is the operational mode, albeit shown with the check valve(s) closed whereas during normal operation they would be open as seen in FIG.

8, illustrating the drop-open condition whereby operation is interrupted, and full flow bypass is enabled as indicated by arrows.

The description above, and the drawings, describe presently preferred embodiments of the invention. Inasmuch as the invention is subject to modification and improvement, the preferred embodiments should be regarded as examples of the invention defined by the claims below.

I claim:

1. A down-hole hammer drill including:

a hammer casing having an interior surface with a plurality of longitudinal grooves formed therein;

a top sub at the upper end of said casing, adapted to connect the hammer to a pressurized drill string, the drill string and top sub forming a compressed air supply;

a drill bit comprising a bit shank extending from a bit head to an anvil end and a bit head mounted on said bit shank;

a plurality of key and keyway pairs arranged in spaced relation circumferentially about the bit shank and the casing bore;

a free piston motor powered by said air supply and dividing the casing into an upper working chamber defined between an upper piston hammer face and the top sub and a lower working chamber between a piston hammer face and the anvil end of the drill bit;

an air control assembly on which the free piston slides, said assembly including a ported tube extending axially from said air supply to an axial bore in the shank of the bit to guide exhaust air through discharge ports at the cutting face of the bit, the bit reciprocating on the end of the tube; and upper and lower check valves in the air control assembly and openable by supply pressure against a spring bias in response to working fluid supply pressure;

wherein the shank is located and retained within the casing by sacrificial drive pins and sacrificial linear retention pins.

2. The invention of claim 1, wherein the drill head has a bore with helical threads formed therein, and the drill shank has an externally threaded end upon which the drill head can be mounted.

3. The invention of claim 1, wherein the upper check valve is adapted to be actuated from above via a connecting rod independently of the lower check valve.

4. A down-hole hammer drill including:

a hammer casing having an interior surface with a plurality of longitudinal grooves formed therein;

a top sub at the upper end of said casing, adapted to connect the hammer to a pressurized drill string, the drill string and top sub forming a compressed air supply;

a drill bit comprising a bit shank extending from a bit head to an anvil end and a bit head mounted on said bit shank;

a plurality of key and keyway pairs arranged in spaced relation circumferentially about the bit shank and the casing bore;

a free piston motor powered by said air supply and dividing the casing into an upper working chamber defined between an upper piston hammer face and the top sub and a lower working chamber between a piston hammer face and the anvil end of the drill bit;

an air control assembly on which the free piston slides, said assembly including a ported tube extending axially from said air supply to an axial bore in the shank of the bit to guide exhaust air through discharge ports at the cutting face of the bit, the bit reciprocating on the end of the tube; and upper and lower check valves in the air control assembly and openable by supply pressure against a spring bias in response to working fluid supply pressure;

wherein the piston has a bush for sealing, guidance and port timing.

5. The invention of claim 4, wherein the bush is made of a polymeric material.

* * * * *